US006089159A

United States Patent [19]

Gorter

[11] Patent Number: 6,089,159

[45] Date of Patent: Jul. 18, 2000

[54] CHAMBERED DOCTOR BLADE SYSTEM

[76] Inventor: Cornelis Gorter, Naaldhof 17, 8071 AX Nunspeet, Netherlands

[21] Appl. No.: 09/140,901

[22] Filed: Aug. 26, 1998

[30] Foreign Application Priority Data

Aug. 27, 1997 [NL] Netherlands ..... 1006861

[51] Int. Cl.[7] ..... B41F 31/02

[52] U.S. Cl. ..... 101/366; 101/154; 101/350.1

[58] Field of Search ..... 101/366, 367, 101/363, 364, 365, 153, 154, 155, 156, 157, 350.1, 350.5, 350.6

[56] References Cited

U.S. PATENT DOCUMENTS

| | | | |
|---|---|---|---|
| 4,958,561 | 9/1990 | Grosshauser et al. | 101/363 |
| 4,998,474 | 3/1991 | Hauer | 101/366 |
| 5,226,363 | 7/1993 | Weishew | 101/366 |
| 5,335,596 | 8/1994 | DeMoore et al. | 101/350 |
| 5,517,918 | 5/1996 | Van Denend | 101/363 |
| 5,671,673 | 9/1997 | Boose et al. | 101/363 |
| 5,768,993 | 6/1998 | Stuart | 101/366 |
| 5,791,248 | 8/1998 | Atkins et al. | 101/350.6 |
| 5,826,509 | 10/1998 | Deneka | 101/366 |

FOREIGN PATENT DOCUMENTS

WO 93/10976 6/1993 WIPO .

WO 93/24328 12/1993 WIPO .

*Primary Examiner*—Edgar Burr
*Assistant Examiner*—Minh H. Chau
*Attorney, Agent, or Firm*—Dehlinger & Associates

[57] ABSTRACT

System for applying a pumpable substance (printing liquid) to running material webs, comprising a chambered doctor blade casing provided with a space for pumpable substance; an inlet and an outlet for pumpable substance; and at least two doctor blades detachably mounted on the chambered doctor blade casing, which blades bound an opening which, in operation, faces the outer circumference of a roller and which extends over the length of the chambered doctor blade casing, and the chambered doctor blade casing being sealed at its end faces by detachable seals.

The chambered doctor blade casing comprises a detachable inner trough of the chambered doctor blade, which inner trough is formed from thin plate and essentially consists of an M-shaped section which is open on one side and has inwardly bent-over feet, and a supporting construction for the inner trough of the chambered doctor blade, which comprises members for attachment to suspension members in a printing or coating machine and against which the inner trough of the chambered doctor blade abuts with a proper fit, the inner trough of the chambered doctor blade and the supporting construction being provided with openings for passing through the inlet and outlet of pumpable substance.

18 Claims, 2 Drawing Sheets

CHAMBERED DOCTOR BLADE SYSTEM

Figure 1:
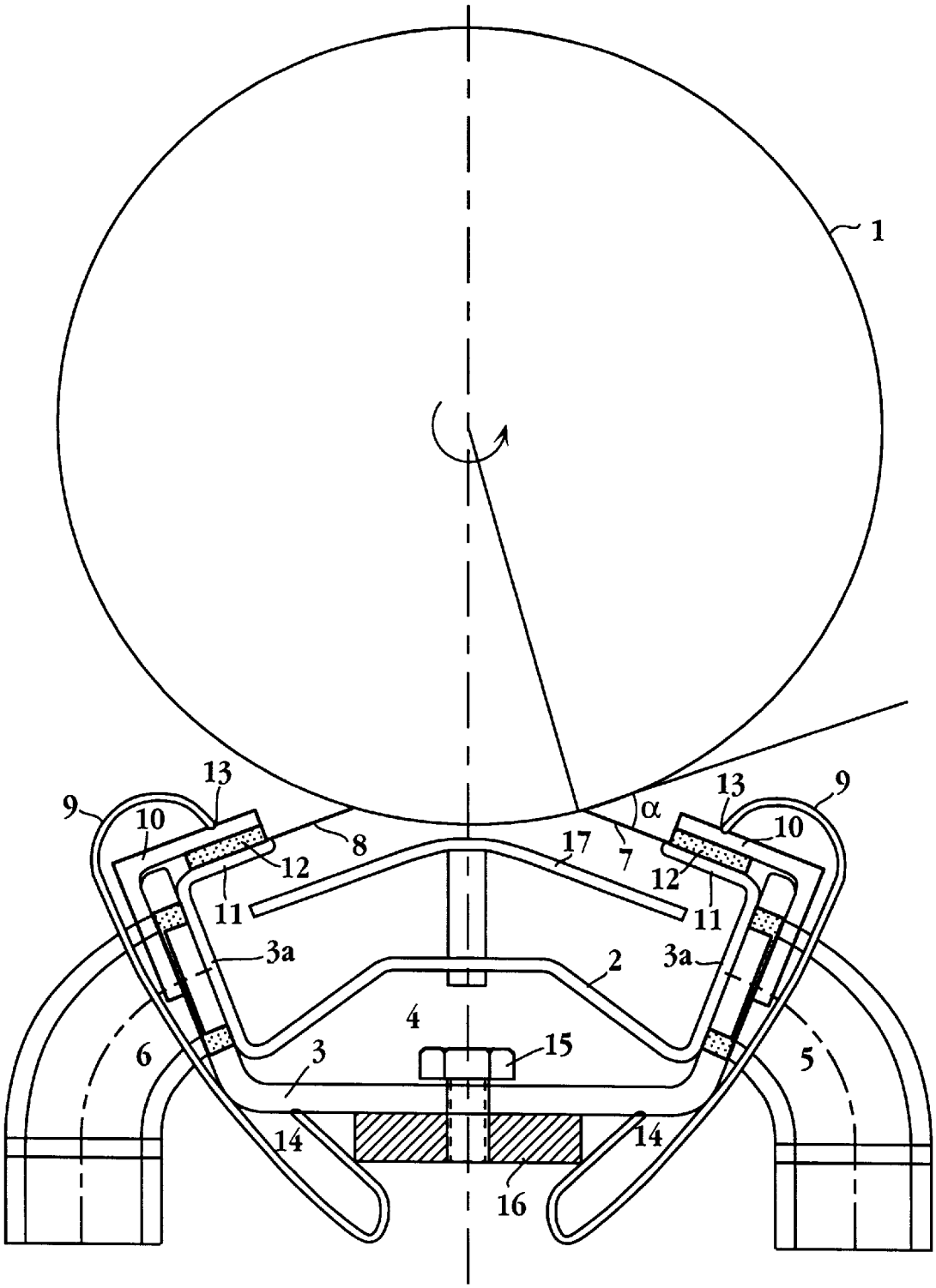

The invention relates to a system for applying a pumpable substance to running material webs or parts thereof, comprising a chambered doctor blade casing provided with a space for the pumpable substance; at least one inlet and at least one outlet for the pumpable substance; and at least two doctor blades detachably mounted on the chambered doctor blade casing, which blades bound an opening which, in operation, faces the outer circumference of a roller and which extends over the length of the chambered doctor blade casing, and the chambered doctor blade casing being sealed at its end faces by detachable seals.

Such apparatus is known from international patent publication WO 93/10976. This publication involves in particular a "Farbkammerrakel" or chambered doctor blade for coating or intaglio printing, where the pumpable substance, for instance printing liquid (printing ink), to be applied to the material web or a part thereof, is fed to the lower part of a chamber or to the center or to both ends or to the center and both ends, depending on the length.

The pumpable substance rotating in the chamber at the surface of the roller then flows in longitudinal direction in the chambered doctor blade casing, parallel to the roller, to leave the chamber again in the upper part.

The object of chambered doctor blade systems is to distribute a liquid or a pumpable substance (printing liquid) behaving like a liquid, evenly over a gravure, screen, etched or intaglio printing roller, for directly or indirectly transferring this substance, evenly distributed over the roller, onto material webs or a material web of finite or infinite length. Material webs of finite length are for instance aerosol cans and the like. Material webs of infinite length are for instance rolls of film which are or are not glued together to form one web. These techniques for evenly distributing and transferring a pumpable substance onto material webs are known per se to skilled persons and will therefore not be described in detail here.

Further, doctor blades are mounted on the chambered doctor blade casing which scrapes the pumpable substance rotating through the turning roller from the roller.

Such apparatus involve the phenomenon that the roller, provided with a number of small cups or engravings at its circumference, becomes silted up by pigment parts contained in the liquid to be applied or by crystallization of the liquid to be applied, and can no longer transfer the required amount of liquid, as a consequence of which the printing quality decreases. Next, a chemical cleaning of the roller is necessary, which is environmentally harmful and may give rise to environmental problems.

Further, during operation, contamination of poorly accessible parts of the chambered doctor blade casing and wear of the doctor blades (along which, after all, the circumferential surface of the rotating roller moves) are caused, as a consequence of which a poor system operation and a more or less serious leakage occur. Accordingly, servicing in the form of cleaning the chambered doctor blade casing and readjusting or replacing the doctor blades, should take place regularly. For this purpose, the system is swivelled away from the roller and maintenance takes place, which, however, is laborious and time-consuming.

Further, it appears that when a screen roller is used, there is a substantial chance that during refilling of the cups they are filled with printing liquid mixed with air, which leads to a quality decrease of the material to be printed. Also, the manufacturing costs of the known apparatus are high.

Hence, there is an urgent need for a simple and relatively light system construction which is readily and quickly accessible for inspection, cleaning and checking, or replacement of the doctor blades.

The invention satisfies this need and to that end, the system according to the invention is characterized in that the chambered doctor blade casing comprises a detachable inner trough of the chambered doctor blade, which inner trough is formed from thin plate and consists of an essentially M-shaped section which is open on one side and has inwardly bent-over feet, and a supporting construction for the inner trough of the chambered doctor blade, which construction comprises members for attachment to suspension members in a printing or coating machine and against which the inner trough of the chambered doctor blade abuts with a proper fit, both the inner trough of the chambered doctor blade and the supporting construction being provided with openings for passing through the inlet and outlet of the pumpable substance.

In this manner, the inner trough of the chambered doctor blade can very easily and quickly be removed from the supporting construction for carrying out maintenance and inspection. Also, in this manner, the inner trough of the chambered doctor blade can readily and easily be changed, which is for instance of importance when the type of pumpable substance is changed.

Hereinafter, the invention will be further explained on the basis of the accompanying drawings and the specification.

Figure 2A:
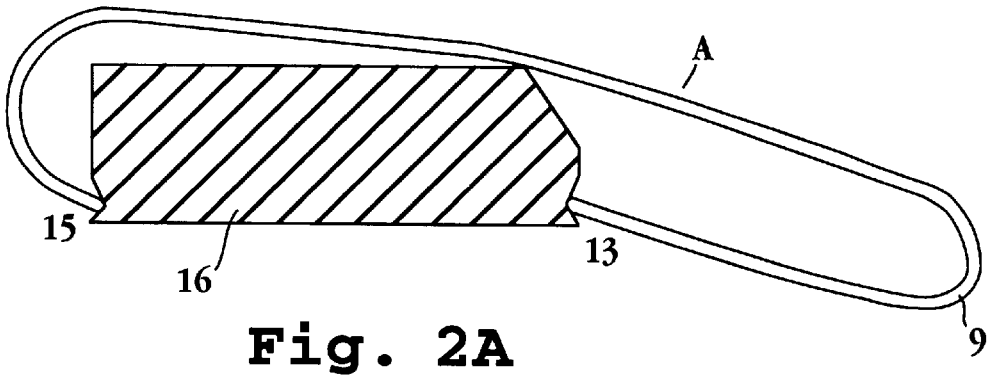
Figure 2B:
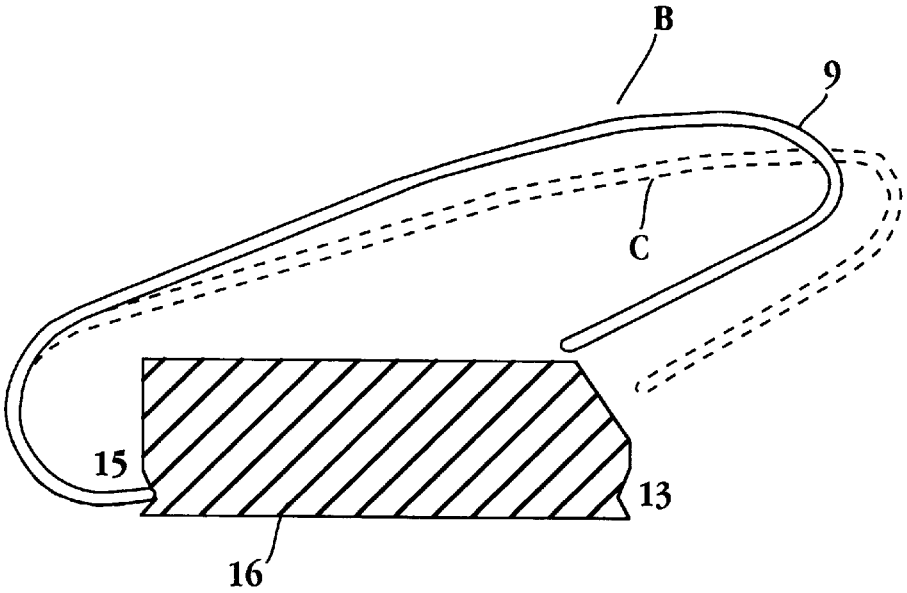

FIG. 1 shows a cross section of an advantageous embodiment according to the invention; and FIGS. 2*a* and 2*b* show a detail of the embodiment according to FIG. 1.

By way of example, the invention will now be described for use with a screen roller, but the invention is not limited thereto.

Referring to FIG. 1, reference numeral 1 designates a screen roller of a printing apparatus. The technique of transmitting a pumpable substance, such as printing liquid, onto the material to be printed by means of a chambered doctor blade system via a rotating screen roller and a printing block is known per se to skilled persons and will not be described in further detail. The cross section of the screen roller is usually between 60 and 300 mm, while the length thereof may vary. In a conventional screen roller with a cross section of 127.3 mm, the length is for instance 900 mm, while a conventional screen roller with a cross section of 187 mm has a length of 1300 mm.

The screen roller 1 contains at its circumference a number of cups (not shown) which receive the printing liquid during rotation along an inner trough 2 of the chambered doctor blade, which trough has the shape of an essentially M-shaped profile (for instance made of a corrosion-proof material, such as stainless steel) which is open on one side and has inwardly bent-over feet 11. Via a block printing roller (not shown), ink is subsequently transferred onto the material to be printed (not shown). The essentially M-shaped section 2 is for instance a drawn or bent section and is detachably arranged with a proper fit in a supporting construction 3 which is open on at least one side and which is preferably trapezoidal. The section 2 abuts against the walls 3*a* of the construction 3. The section 2 and the supporting member 3 are provided with openings for passing through an inlet 6 and an outlet 5 of printing liquid.

Sealing can take place in any suitable manner, for instance by means of O-rings. Further, two doctor blades 7 and 8 are provided at a particular angle $\alpha$ relative to the circumferential surface of the screen roller 1 (here approximately 45°) and bound the opening of the chambered doctor blade casing, which opening is directed to the outer circumference of the screen roller 1 and extends over the length of the inner trough 2 of the chambered doctor blade.

Provided at the end faces of the essentially M-shaped section 2 is a detachable seal (not shown) for preventing leakages. By means of a clamping member 9 (for instance a leaf spring), the doctor blades 7 and 8 are clamped against the inwardly bent-over foot 11 of the section 2 via an elastic or resilient member 12 suitable therefor (for instance rubber) and a recess 13 in the contact strip 10. The other end of the leaf spring 9 ends in a recess 14 provided in the outer wall of the supporting member 3. This construction does not involve any mechanical connections, such as screws and the like, between doctor blade and chambered doctor blade casing, enabling the doctor blades to be removed from the inner trough 2 very quickly for maintenance and inspection. In this manner, the clamping member fixes the inner trough of the chambered doctor blade in the supporting construction, and upon removal of the clamping member 9 the section 2 lies directly loose from the supporting member 3.

Reference numerals 15 and 16 designate a mechanical connection between the supporting member 3 and the other parts of the system (not shown). It is observed that this attachment should be carried out such that the chambered doctor blade casing can be moved radially from the circumferential surface of the screen roller and, if necessary, can subsequently be swivelled aside in the case of cleaning and/or replacement operations, etc.

Reference numeral 17 schematically shows a flow plate provided on the section 2 in any manner suitable therefor, for guiding the printing liquid along the circumference of the screen roller. Preferably, the flow plate has a rectangular starting shape and is bent such that the bending line makes a small angle with the diagonal of the plate. The bending line of the flow plate preferably extends axially and parallel to the screen roller. The flow plate may be mounted so as to be rigid or movable/settable towards the screen roller. Preferably, the supporting member 3 extends throughout the length of the inner trough of the chambered doctor blade, but it may also consist of a number (for instance two) mutually separate parts. The sidewalls 3*a* of the essentially M-shaped section 2 abut against the inner walls of the supporting member 3, in such a manner that a part of the section (the center of the "M") has receded relative to the supporting member.

The inner trough (2) of the chambered doctor blade has its end faces bounded by a detachable sealing plate (not shown) which preferably by means of a leaf spring construction (not shown) provides a resilient sealing, preferably by means of a sealing plate holder (not shown) and a resilient member attached to the inner trough (2) of the chambered doctor blade by a member suitable therefor (not shown).

This further has the advantage that if the inner trough of the chambered doctor blade has to be changed for a clean inner trough, printing liquid adhering to the inside of the moistened surface does not pass to the outside (environmentally friendly).

It is observed that the detachable sealing plate is not attached to the inner trough by means of screws and the like, but is pressed against the ends of the inner trough exclusively by means of a spring member. In this manner, the sealing plate can be removed very quickly for cleaning or replacement operations, etc.

FIGS. 2*a* and 2*b* respectively show the clamping member 9 in tensioned condition (A), untensioned condition (B) and pre-tensioned condition (C) (before fitting).

In these Figures, the recesses 13 and 14 of FIG. 1 are shown as well. For clarity's sake, the M-shaped section with supporting member is shown schematically as block 16 on which the forces act.

However, it will be understood by skilled persons that the invention is not limited to the use of the clamping member 9 as shown. The doctor blades 7 and 8 may be clamped against or attached to the foot 11 of the section 2 in any manner suitable therefor.

It is claimed:

1. A system for applying a pumpable substance to running material webs or parts thereof, comprising:

a chambered doctor blade casing provided with a space for the pumpable substance;

at least one inlet and at least one outlet for the pumpable substance; and at least two doctor blades detachably mounted on the chambered doctor blade casing, said blades bounding an opening which, in operation, faces an outer circumference of a roller and which extends over the length of the chambered doctor blade casing, and the chambered doctor blade casing being sealed at its end faces by detachable seals, characterized in that the chambered doctor blade casing comprises a detachable inner trough, said inner trough being formed of a thin plate having an essentially M-shaped section which is open on one side and has inwardly bent-over feet, and a supporting construction for the inner trough of the chambered doctor blade casing, the supporting construction having members for attachment to suspension members in a printing or coating machine and against which the inner trough of the chambered doctor blade abuts with a proper fit, both the inner trough of the chambered doctor blade casing and the supporting construction being provided with openings for passing through the inlet and outlet of the pumpable substance.

2. The system according to claim 1, characterized in that the inner trough of the chambered doctor blade casing has end faces bounded by a detachable sealing plate providing a resilient sealing by means of a sealing plate holder and a resilient member attached to the inner trough of the chambered doctor blade casing.

3. The system according to claim 2, characterized in that the sealing takes place by means of a leaf spring construction.

4. The system according to claim 1, characterized in that the essentially M-shaped section is a drawn or bent section.

5. The system according to claim 1, characterized in that the essentially M-shaped section is manufactured from a stainless steel plate.

6. The system according to claim 1, characterized in that the inner trough of the chambered doctor blade casing contains a flow plate.

7. The system according to claim 6, characterized in that the flow plate has a rectangular starting shape and is bent such that the bending line makes a small angle with the diagonal of the plate.

8. The system according to claim 7, characterized in that the bending line of the flow plate extends axially and parallel to the roller.

9. The system according to claim 6, characterized in that the flow plate is rigidly mounted on the section.

10. The system according to claim 6, characterized in that the flow plate is mounted so as to be movable towards the roller.

11. The system according to claim 1, characterized in that the doctor blades are clamped on the inner trough of the chambered doctor blade casing by means of a clamping member.

12. The system according to claim 11, characterized in that the clamping member fixes the inner trough of the chambered doctor blade casing in the supporting construction.

13. The system according to claim 11, characterized in that the clamping member consists of a leaf spring of which one end ends in a recess provided in the outside of the supporting construction and the other end ends in a recess of a contact strip which, via an elastic or resilient member, ends against the doctor blade.

14. The system according to claim 1, characterized in that the supporting member extends throughout the length of the inner trough of the chambered doctor blade.

15. The system according to claim 1, characterized in that the supporting member consists of a number of mutually separate parts.

16. The system according to claim 15, characterized in that the number of parts is two.

17. The system according to claim 1, characterized in that the supporting member is trapezoidal with one open side, facing the circumference of the roller.

18. The system according to claim 1, characterized in that the essentially M-shaped section includes sidewalls which abut against inner walls of the supporting member and that a center part of the M-shaped section is receded relative to a side of the supporting member facing away from the roller.

* * * * *